US006742315B2

(12) United States Patent
Linn

(10) Patent No.: US 6,742,315 B2
(45) Date of Patent: Jun. 1, 2004

(54) METHOD OF MAKING A WALL SYSTEM

(76) Inventor: Jimmie L. Linn, P.O. Box 121, Twin Falls, ID (US) 83301

( * ) Notice: Subject to any disclaimer, the term of this patent is extended or adjusted under 35 U.S.C. 154(b) by 59 days.

(21) Appl. No.: 10/044,383

(22) Filed: Jan. 11, 2002

(65) Prior Publication Data

US 2002/0088199 A1 Jul. 11, 2002

Related U.S. Application Data

(60) Provisional application No. 60/261,143, filed on Jan. 11, 2001.

(51) Int. Cl.[7] ..... E04B 1/00

(52) U.S. Cl. ..... 52/745.1; 52/783.19; 52/798.1; 52/DIG. 15

(58) Field of Search ..... 52/783.19, 783.11, 52/798.1, 537, 539, 555, 796.1, 745.05, 782.1, DIG. 15, 671, 674, 630, 220.4, 745.09, 745.1

(56) References Cited

U.S. PATENT DOCUMENTS

| | | | | |
|---|---|---|---|---|
| 1,867,433 A | * | 7/1932 | Young | 52/506.1 |
| 2,095,434 A | * | 10/1937 | Calkins et al. | 52/469 |
| 2,124,827 A | | 7/1938 | Michel | 189/88 |
| 2,302,949 A | * | 11/1942 | Palmer | 52/588.1 |
| 2,873,008 A | | 2/1959 | Ashman | 189/86 |
| 3,110,130 A | | 11/1963 | Trachtenberg | 50/245 |
| 3,184,892 A | | 5/1965 | Silberkuhl et al. | 50/52 |
| 3,555,756 A | | 1/1971 | Curran et al. | 52/309 |
| 4,759,165 A | * | 7/1988 | Getoor et al. | 52/528 |
| 5,172,527 A | * | 12/1992 | Ault | 52/145 |
| 5,299,405 A | * | 4/1994 | Thompson | 52/795 |
| 5,612,117 A | * | 3/1997 | Belanger et al. | 428/178 |
| 5,675,955 A | | 10/1997 | Champagne | 52/521 |
| 5,729,946 A | | 3/1998 | Beck | 52/520 |
| 5,775,042 A | | 7/1998 | Mowery et al. | 52/520 |

FOREIGN PATENT DOCUMENTS

JP 406306986 A * 11/1994 ..... 52/798.1

OTHER PUBLICATIONS

"PLYCEM", 1998, U.S. Architectural Products, Inc.*
"ROCK–ON and BACKER–ON Cement Board Fasteners", 1998–2003, ITW Buildex, pp. 1–2.*
"Metal Construction News" Feb. 1997, Article Entitled "Panel Offers Exterior Alternative for Metal Building".

* cited by examiner

*Primary Examiner*—Carl D. Friedman
*Assistant Examiner*—Naoko Slack
(74) *Attorney, Agent, or Firm*—Stephen M. Nipper; Frank J. Dykas; Robert L. Shaver

(57) ABSTRACT

The present invention is a method of making a building wall panel or building wall panel system. The building wall panels are made by taking a standard panel of metal roof decking having alternating ridges and channels and attaching a length of board stock, such as a concrete board. These panels are then able to be attached to a steel frame or other type building shell.

10 Claims, 3 Drawing Sheets

METHOD OF MAKING A WALL SYSTEM

PRIORITY

This application claims priority from co-pending provisional application number 60/261,143, filed on Jan. 11, 2001, entitled "Method of Making a Wall System," the disclosure of which is incorporated herein by reference.

DESCRIPTION

BACKGROUND OF THE INVENTION

1. Field of the Invention

The present invention generally relates to construction, and more particularly to building wall panels.

2. Background Information

It is common in commercial building construction throughout the world to build buildings through first building a structural frame and then attaching to the outside surface of the structural frame an exterior skin of metal, masonry, limestone, marble, granite, and/or precast concrete panels.

It is also well known in the art to use steel decking members to form roofing materials, or as floor members wherein the steel decking is laid out in a horizontal fashion and filled with concrete. The great benefits in steel roof and floor decking is in its great strength and rigidity. An example of such ideal decking is manufactured by Vulcraft, as a "Conform (Type "C")" styled decking.

It is also known in the art the creation of board stock which is a composite of concrete and wood fibers. These boards are often referred to as wood cement boards or cement boards, a typical kind being manufactured by Allied Building Products Corporation of East Rutherford, N.J., under the trademark VIROC®. The benefits in using such a cement board are the great water resistance, freeze/thaw resistance, fire resistance, impact resistance, and sound resistance.

What is needed is a method of combining the benefits of steel decking with the benefits of wood cement boards to create building wall panels which can be fabricated off-site, hauled to the job site and erected vertically. The present invention solves this need.

SUMMARY OF THE INVENTION

The present invention is a method of making a building wail panel or building wall panel system. The building wail panels are made by taking a standard panel of metal roof decking having alternating ridges and channels and attaching a length of board stock, such as a concrete board. These panels are then able to be attached to a steel frame or other type building shell.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
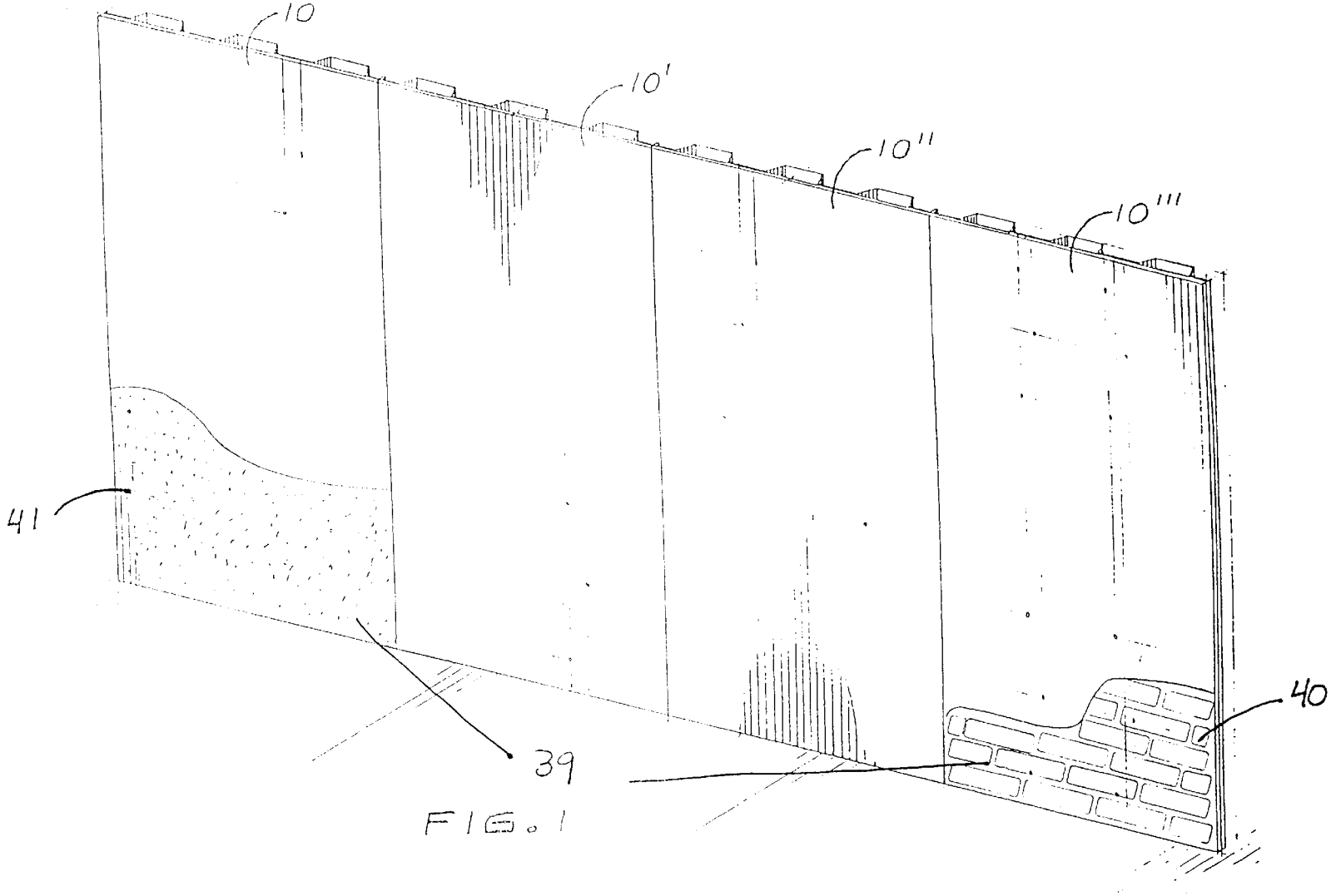
FIG. 1 is an environmental view of four panels of a first embodiment of the present invention used as a wall system.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is a building wall panel and method of making such a building wall panel. Referring initially to FIG. 1, panels of one embodiment of the invented wall panel are shown. This figure shows four panels 10, 10', 10", 10''' of the present invention placed together in series. This series of panels, in use, are attached to a framed building exterior surface, such as a red iron steel building frame.

Figure 2:
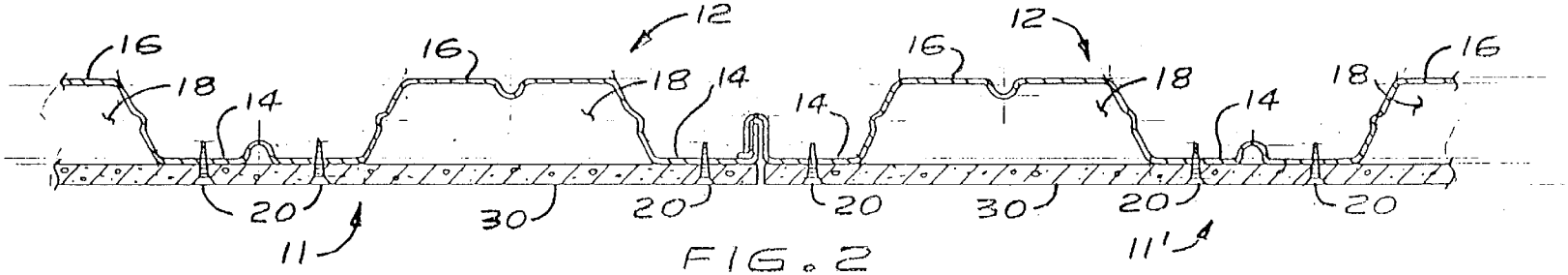
FIG. 2 is a partial cross-sectional view of a second embodiment of the present invention.

Referring now to FIG. 2, a partial, cross-sectional view of a pair of adjacent panels 11, 11' of a second embodiment of the present invention are shown. Each of these panels 11, 11' are made of a piece of metal decking 12, and piece of board stock 30.

The preferred decking 12 is standard galvanized steel decking standardly used in construction for mainly roof and flooring purposes. An example of such decking is made by Vuicraft, a division of Nucor Corporation, as "2C Conform" steel decking. This decking comes in standard widths of 36 inches wide and is corrugated, having alternating 5-inch long ridges 14 on each side. Innerspaced between these ridges 14 are channels 16. The preferred decking has ridges/channels which are at least 2–3" wide, and can be of any gauge steel or other material. It is also envisioned to use any other type of metal decking, preferably corrugated, each of which may have various different measurements, including different ridge widths.

Figure 4:
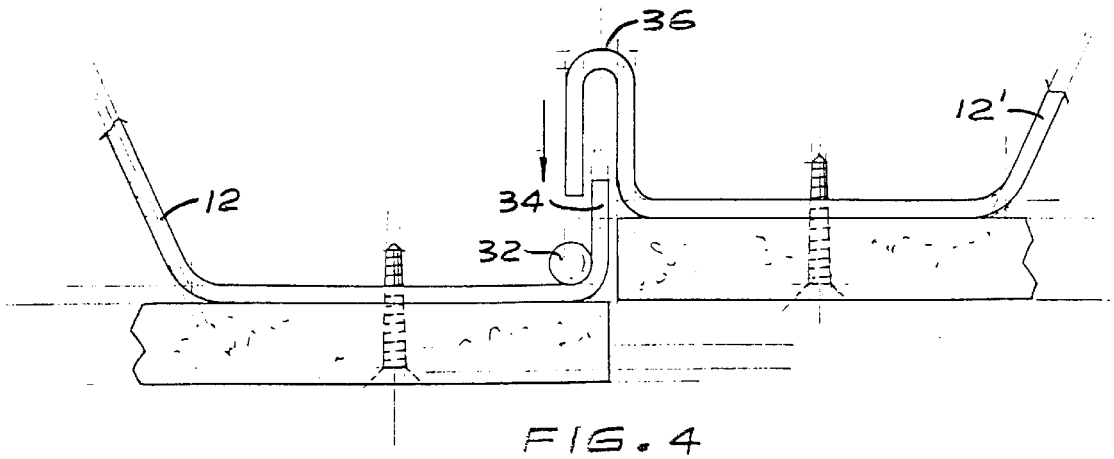
FIG. 4 is a first sequential, partial, end view of a fourth embodiment of the present invention.
Figure 5:
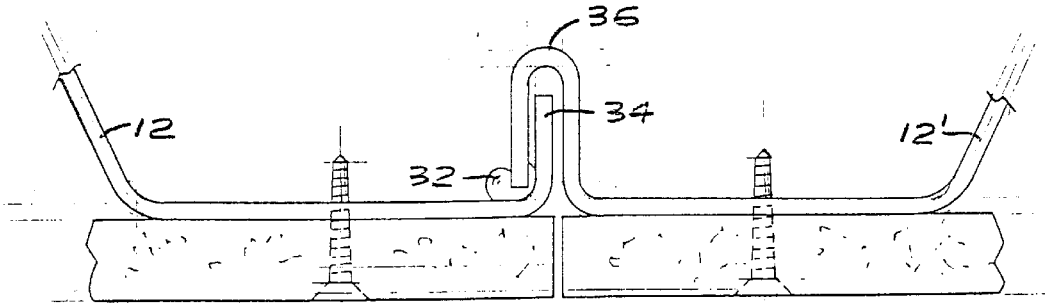
FIG. 5 is a second sequential, partial, end view of the embodiment of FIG. 4.
Figure 6:
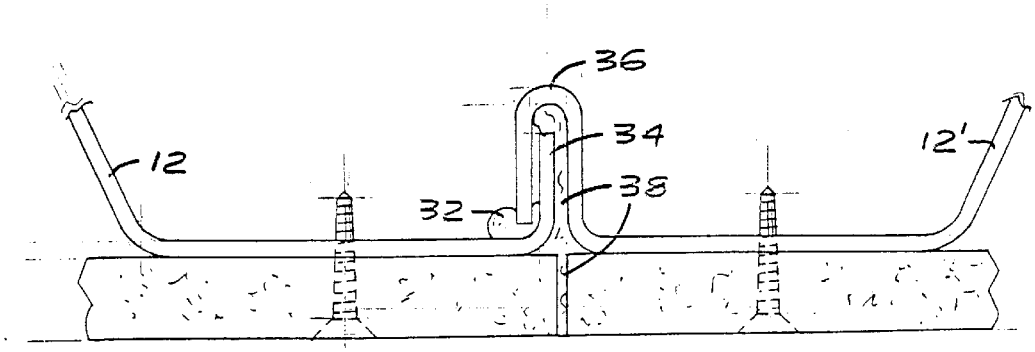
FIG. 6 is a third sequential, partial, end view of the embodiment of FIG. 4.

In the preferred embodiment, adjacent panels 12 of this style decking are able to lock together through the tongue and groove style overlap shown FIGS. 4–6 (discussed infra). Similar decking is made by many different manufacturers, including Verco Manufacturing Company of Phoenix, Ariz.

Attaching to this steel decking 12 of the panels 11, 11' is a board stock 30. While various types of board stock 30 are envisioned, including board stock made of lumber, particle board, concrete itself, or various other types of boarding, the preferred board used with the present invention is a wood cement board. An example of such a wood cement board is manufactured under the trademark VIROC® by Allied Building Products Corporation of East Rutherford, N.J. The VIROC® concrete boards are cement bonded particleboards which are made of particles of wood and Portland cement. This combination results in a board having the strength and flexibility of wood, and has the durability and resistant qualities of cement (for instance, termite resistance). Cement boards come in various thicknesses, widths and lengths, however, any thickness, width or length can be used with the present invention, and with the preferred width being roughly the width of the decking panel attached thereto. It is preferred to additionally use a length of board stock which is roughly the length of the decking panels attached thereto.

The attachment of the board 30 to the decking results in a plurality of pockets 18 which are able to receive insulation. The cement board 30 or boards attach to the ridges of the decking 12. Such attachment can be done through any appropriate means, including, but not limited to fasteners, such as bolts, screws, nails, and adhesives. In the preferred embodiment, as shown in FIGS. 2 and 3, the cement board 30 is approximately the width of the decking 12, and are screwed to the ridges 14 of the decking through use of screws 20.

The embodiment shown in FIG. 2 would then be attached to a building exterior with the channel 16 side attaching to the building, and the cement board 30 side facing outwards.

Figure 3:
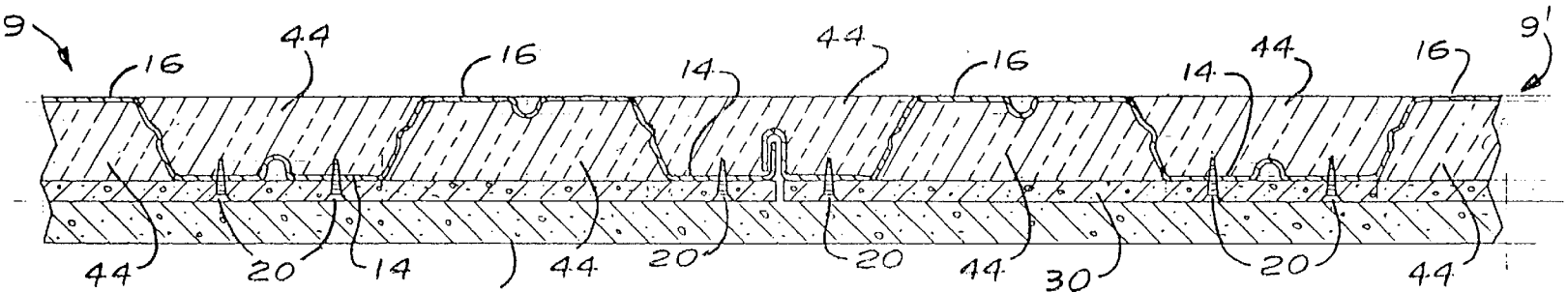
FIG. 3 is a partial cross-sectional view of a third embodiment of the present invention.

Referring now to FIG. 3, the versatility of the invented panels can be seen. In this embodiment, a pair of connected panels 9, 9' are shown. Each panel 9, 9' comprises a decking panel 12 attaching to a panel of board stock 30 through use of fasteners 20. The board stock 30 attaches to the ridges 14 of the panels 9, '9.

The ability to insulate the panels 9, '9 is shown. Insulation is optional. For instance, insulation 44 is shown in the channels between adjacent corrugations of the decking panels 12. This insulation 44 could be any common type of insulating material, including, but not limited to Styrofoam, fiberglass, rockwool, cellulose, sprayed on insulation, blown in insulation, and expanding foam. The insulation 44 can be located only facing the board stock 30, only facing the building frame, or could be on both sides of the panels 12 (as shown in FIG. 3). This insulation 44 can be applied before the decking panels 9, 9' are erected or the panels can be insulated after they are installed on the building frame.

The ability to receive decorative finishes 39 on the outer surface of the board stock 30 is also shown. Shown in FIG. 1 is the application of two types of finishes 39, namely a brick applique outer surface treatment 40 and a stucco outer surface treatment 41. There are numerous types of outer surface treatments can be applied to the panels, including, but not limited to natural and man-made products such as stone, stucco, acrylic textures, siding, and other treatments. These treatments would be attached to the outer surface of the board stock 30 through any of the common means known to those skilled in the art, including, but not limited, to adhesives and fasteners. These treatments can be applied on the job site or at the factory.

Referring to FIGS. 4–6, shown is a sequential view of another embodiment of the present invention. Particularly, these figures show the joining of adjacent panels. This joining method is common with the preferred decking panels 12 manufactured by Vulcraft and other manufacturers. The inventor adds to this standard joining method a method of sealing the joint.

Referring first to FIG. 4, shown is a first panel 12 to be joined with a second panel 12'. The first panel 12 has a tongue 34, and the second panel 12' has a groove 36 for receiving the tongue 34. Any standard way can be used to further join the two panels together, including but not limited to, drilling a screw through the groove walls, through the tongue, and into the second groove wall (not shown).

Sealing the joint can be done by placing a backer rod 32 of a compressible material, such as foam, plastic or rubber, adjacent the tongue 34. Then, as the tongue 34 is inserted within the groove 36, this backer rod 32 is compressed by the tip of the groove 36, thereby forming a seal (FIG. 5). This joint can be further sealed by adding a caulking material 38 to the front side of the joint, through the adjacent board stock panels, and into the groove 36. This caulking material can be a fire rated caulk.

The preferred method of manufacture of the invented wall panels involves first taking one of the deck panels and laying upon that deck panel a sheet of the board stock. Screws are then used to screw the board stock to the deck panels, preferably at the ridges. It is preferred that the screws be countersunk and finished. This wall panel is then able to be shipped to the job site and be erected.

Before the board stock is applied to the deck panel, the channels of the panel can be insulated. For instance, Styrofoam insulation could be applied. It is also possible to join the board stock to the deck panel and then apply the insulation, for instance by blowing in insulation, sliding in an insulation insert, or by injecting in an expanding foam.

The invented panel could also be used as a floor panel or a roof panel.

While there is shown and described the present preferred embodiment of the invention, it is to be distinctly understood that this invention is not limited thereto but may be variously embodied to practice within the scope of this application.

I claim:

1. A construction method, said method comprising the steps of:

providing a first corrugated galvanized steel decking panel and a second corrugated galvanized steel decking panel, each of said panels comprising: a top and a bottom defining a length there-between, said panel having a first side and a second side defining a width there-between, said panel having a first face and a second face, said panel having a number of ridges and channels parallel to said panel's length, said ridges and channels in said first face and said second face, wherein insulation is placed in at least one of said channels, said first side defining a first tongue and said second side defining a first groove, said first tongue for interlocking with the groove of a second panel, said first groove for interlocking with the tongue of a third panel, a piece of wood cement board stock attached to said first face of said decking panel by screwing a plurality of screws through said board stock and into said decking panel;

attaching said the second face of said first panel to the steel frame of a building, said first panel second face facing toward said steel frame, said first panel first face facing generally away from said steel frame;

attaching said the second face of said second panel to said steel frame of said building, said second panel second face facing toward said steel frame, said second panel first face facing generally away from said steel frame, whereby the tongue of one of said panels interlocks with the groove of the other of said panels; and attaching a decorative outer surface treatment to said first panel first faces.

2. The construction method of claim 1 wherein said groove has a tip and wherein a backer rod of compressible material is placed on said second face adjacent said tongue so that through the interlocking of said panels said tip compresses said backer rod thereby forming a seal.

3. The construction method of claim 2 wherein the attachment between said panels define a joint, said joint being further sealed by adding a caulking material to the first face through the adjacent board stock panels and into the groove.

4. The construction method of claim 3 wherein the caulking material is a fire rated caulk.

5. A construction method, said method comprising the steps of:

providing a first corrugated galvanized steel decking panel and a second corrugated galvanized steel decking panel, each of said panels comprising: a top and a bottom defining a length there-between, said panel having a first side and a second side defining a width there-between, said panel having a first face and a second face, said panel having a number of ridges and channels parallel to said panel's length, said ridges and channels in said first face and said second face, wherein insulation is placed in at least one of said channels, said first side defining a first tongue and said second side defining a first groove, said first tongue for interlocking with the groove of a second panel, said first groove for interlocking with the tongue of a third panel, wherein said grooves have a tip and wherein a backer rod of compressible material is placed on said second face adjacent said tongue so that through the interlocking of said panels said tip compresses said backer rod thereby forming a seal, a piece of wood cement board stock attached to said first face of said decking panel by screwing a plurality of screws through said board stock and into said decking panel;

attaching said the second face of said first panel to the steel frame of a building, said first panel second face facing toward said steel frame, said first panel first face facing generally away from said steel frame;

attaching said the second face of said second panel to said steel frame of said building, said second panel second face facing toward said steel frame, said second panel first face facing generally away from said steel frame, whereby the tongue of one of said panels interlocks with the groove of the other of said panels; and attaching a decorative outer surface treatment to said first panel first faces.

6. The construction method of claim 5 wherein the attachment between said panels define a joint, said joint being further sealed by adding a caulking material to the first face through the adjacent board stock panels and into the groove.

7. The construction method of claim 6 wherein the caulking material is a fire rated caulk.

8. A construction method, said method comprising the steps of:

providing a first corrugated galvanized steel decking panel and a second corrugated galvanized steel decking panel, each of said panels comprising: a top and a bottom defining a length there-between, said panel having a first side and a second side defining a width there-between, said panel having a first face and a second face, said panel having a number of ridges and channels parallel to said panel's length, said ridges and channels in said first face and said second face, said first side defining a first tongue and said second side defining a first groove, said first tongue for interlocking with the groove of a second panel, said first groove for interlocking with the tongue of a third panel, wherein said grooves have a tip and wherein a backer rod of compressible material is placed on said second face adjacent said tongue so that through the interlocking of said panels said tip compresses said backer rod thereby forming a seal a piece of wood cement board stock attached to said first face of said decking panel by screwing a plurality of screws through said board stock and into said decking panel, wherein the attachment between said panels define a joint, said joint being further sealed by adding a caulking material to the first face through the adjacent board stock panels and into the groove;

attaching said the second face of said first panel to the steel frame of a building, said first panel second face facing toward said steel frame, said first panel first face facing generally away from said steel frame;

attaching said the second face of said second panel to said steel frame of said building, said second panel second face facing toward said steel frame, said second panel first face facing generally away from said steel frame, whereby the tongue of one of said panels interlocks with the groove of the other of said panels; and attaching a decorative outer surface treatment to said first panel first faces.

9. The construction method of claim 8, wherein insulation is placed in at least one of said channels.

10. The construction method of claim 8, wherein the caulking material is a fire rated caulk.

* * * * *